US006431724B1

(12) United States Patent
Tedham et al.

(10) Patent No.: US 6,431,724 B1
(45) Date of Patent: Aug. 13, 2002

(54) BAG WITH HEM MOUNTED LIGHT SOURCE

(76) Inventors: Thomas A. Tedham; Juli K. Tedham, both of 17051 Hanover La., Eden Prairie, MN (US) 55347; Diane S. Brown, 1589 Melrose Ave., Columbus, OH (US) 43224

( * ) Notice: Subject to any disclaimer, the term of this patent is extended or adjusted under 35 U.S.C. 154(b) by 0 days.

(21) Appl. No.: 09/641,952

(22) Filed: Aug. 21, 2000

Related U.S. Application Data

(60) Provisional application No. 60/161,362, filed on Oct. 26, 1999.

(51) Int. Cl.[7] ..... F21V 33/00

(52) U.S. Cl. ..... 362/154; 362/156; 362/103; 362/570; 362/34

(58) Field of Search ..... 362/103, 154, 362/156, 57, 577, 34

(56) References Cited

U.S. PATENT DOCUMENTS 4,926,296 A 5/1990 Blume et al.
5,038,271 A 8/1991 LoBello
5,067,063 A 11/1991 Granneman et al.
5,073,844 A 12/1991 Coyner et al.
5,222,802 A 6/1993 Beck
5,245,517 A 9/1993 Fenton
5,444,605 A 8/1995 Rivera
5,475,574 A 12/1995 Chien
5,567,054 A 10/1996 Dalgleish
5,764,132 A * 6/1998 Hill ..... 340/321
6,099,140 A * 8/2000 Norris ..... 362/156
6,132,059 A * 10/2000 Leibowitz ..... 362/156

* cited by examiner

*Primary Examiner*—Sandra O'Shea
*Assistant Examiner*—Ronald E. DelGizzi
(74) *Attorney, Agent, or Firm*—Hoffman, Wasson & Gitler, PC

(57) ABSTRACT

The invention is a bag having a glow stick incorporated into the hem of the bag. The glow stick is horizontal and extends across the majority of the bag's width. It provides a light source without an independent power source and makes the bag visible from a great distance in the dark. In this way, a driver will see the light of the bag and know that a person carrying the bag is also present. In such a way, the safety of the user is increased.

22 Claims, 2 Drawing Sheets

BAG WITH HEM MOUNTED LIGHT SOURCE

This application claims the benefit of Provisional Application Ser. No. 60/161,362, filed on Oct. 26, 1999.

BACKGROUND OF THE INVENTION

1. Field of the Invention

Lighted bags can be used to enhance safety. This is particularly true for bags used for trick or treating. Small children are usually out after dark on Halloween. Even children accompanied by adults face a risk of not being seen at night by drivers. It is desirable to have some type of light source to make the children visible at a great distance. Such a light source would be conveniently incorporated into something that the child wears or carries. The prior art discloses several lighted bags that can be used for such purposes.

2. Description of the Prior Art

U.S. Pat. No. 4,926,296 (Blume et al) discloses an illuminated carrying bag having transparent windows in the sidewall. Lights are positioned near the transparent portions and the inside surface of the sidewall has a protective flap 39 covering the lights.

U.S. Pat. No. 5,073,844 (Coyner et al) discloses a lighted baggage piece having a pocket extending along two sidewalls and the bottom wall in which a string of lights 84 is placed. The string of lights is connected to a power source located elsewhere in the bag and provides light to the interior of the bag.

U.S. Pat. No. 5,567,054 (Dalgleish) discloses a bag having a transparent pouch in the bottom. A chemiluminescent wand is placed in the opening of the pouch and is activated to provide light.

SUMMARY OF THE INVENTION

The invention is a bag having a glow stick incorporated into the hem of the bag. The glow stick is placed in a horizontal position and extends across the majority of the bag's upper width. It provides a light source without an independent power source and makes the bag visible from a great distance in the dark. In this way, a third party or driver will see the light located in the hem of the bag and be alerted that a person carrying the bag is also present. In such a way, the safety of the user is increased.

The bag uses a glow stick that has a chemiluminescence source. As such, the glow stick does not require its own power source and has no connections between the light stick and power a source. This simplicity increases the durability of the device since there are no connections that can fail and prevent the light source from operating. Preferably, the light source is able to be easily removed and inserted into the hem of the bag. This way, the light source (glow stick) can be easily replaced when it no longer functions. This allows the bag, if used for trick or treating, to be used for many occasions.

It is an object of the invention to provide a bag that increases the safety of the user, by being illuminated.

It is a further object of the invention to provide a lighted bag that can be seen by drivers at night to alert the driver of the presence of the bag user.

It is a further object of the invention to provide a bag having a light source which does not need a separate power source.

It is yet another object of the invention to provide a lighted bag that has a light source which is easily replaceable.

DETAILED DESCRIPTION OF THE INVENTION

Figure 1:
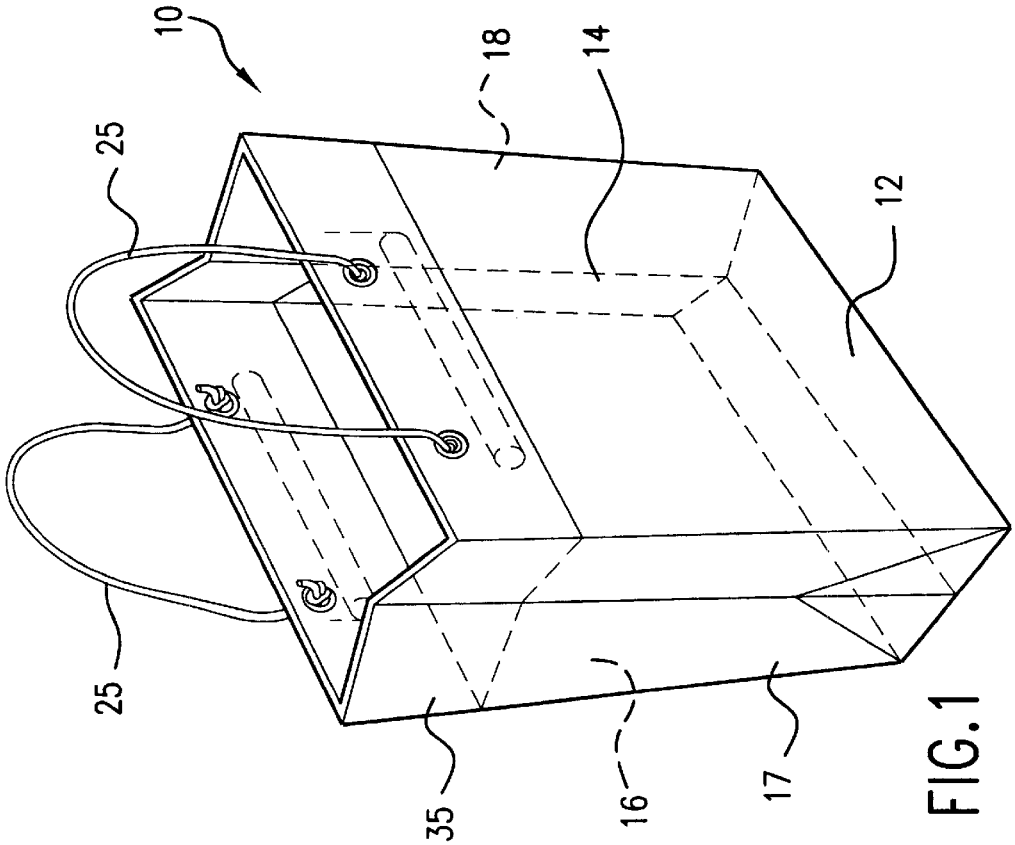
FIG. 1 shows a perspective view of the bag having a glow stick.

The overall configuration of the bag can be seen in FIG. 1. The bag 10 has a distinct bottom wall 12, a front wall 14, back wall 16, and two end walls 17, 18. Preferably, the bag is made of a frosted or translucent plastic material. The bag is provided with rope handles 25 so that the bag is easy to carry. The top edge of the bag is folded over and back up, secured by the handles to create a hem 35 having an inner wall.

The inner wall of the hem is provided with an opening 38. The opening allows a glow stick 50 to be inserted and removed from the hem 35. The glow stick is of conventional construction and is preferably a chemiluminescent glow stick that will provide light for several hours.

Figure 2:
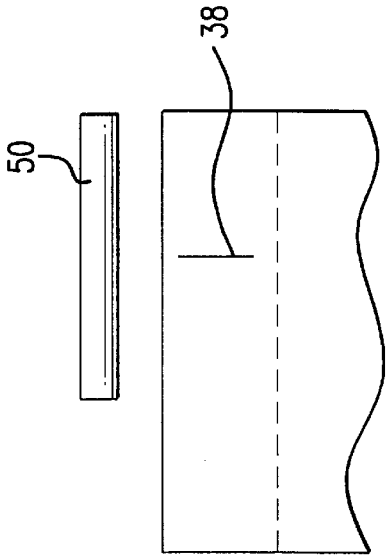
FIG. 2 shows the relationship between the glow stick and the opening in the hem of the bag.

The relationship between the dimension for the glow stick and the opening in the bag 10 can be seen in FIG. 2. The glow stick length can, at most, be equal to the distance between a bag edge and the opening. This relationship allows a glow stick 50 to be as large as possible and still allow it to be inserted and removed from the bag 10. The bag can also be circular in cross-section and have a hem that extends about the entire upper perimeter.

Figure 3:
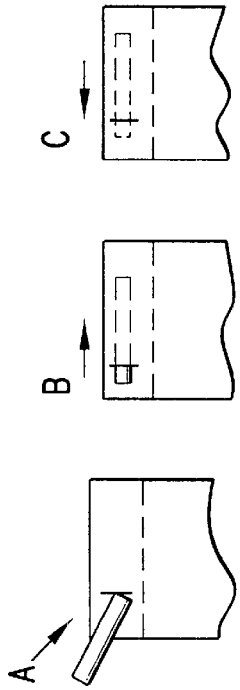
FIGS. 3A–3C depict the method of inserting the glow stick into the bag.

The method for inserting and conversely removing, the glow stick is depicted in FIGS. 3A–3C. As shown in FIG. 3A, the glow stick is pushed through the opening and pushed all the way until it reaches the end of the wall. At this point, because the glow stick is not longer than the perimeter distance of the bag edge to the opening, the second edge of the glow stick can be placed within the opening. Once it is placed in the opening, the glow stick can be moved in the opposite direction, away from the bag edge against which it rests. For removal, the user reverses the process by sliding the glow stick all the way to the edge and pulling one end of the glow stick out from the opening and then pulling the glow stick from the hem.

The arrangement of the invention has numerous advantages over the devices of the prior art.

Firstly, the use of a luminescent wand that does not require its own power source obviates any possibility of a broken connection between the power source and the light source. Since the bag will be carried by the user and transport contents, the possibility of a connection between the power source and the light source failing, is always present and results in the safety function of the bag to no longer exist.

The placement of the light source in the upper sidewall of the bag also has advantages. The prior art discloses the placement of a light source in a lower pouch formed by sealing the front and back walls to one another to form a pouch in the bottom of the bag. This pouch detracts from the volume of the interior of the bag and would otherwise be able to accommodate the contents of the bag. By placement of the light source in sidewall, the full length of the bag is used for the storage of contents. Also, placement of the light source in the sidewall allows two light sources to be used, one in the front wall and one in the back wall. This not only doubles the amount of light available for safety purposes, it also presents a redundant system so that if one light source fails, there is a second, operating light source.

Moreover, having a light source in the upper sidewall allows the opening that accommodates the insertion and removal of the light source to be on the interior of the bag. Then, if by any turn of events, the light source is able to inadvertently slip through the opening after being inserted into the pouch in the side wall, the light source will fall into the interior of the bag and continue to provide the safety features. With a pouch in the bottom wall, any light source which works itself free of the pouch would fall to the ground and, unless noticed by the user, would no longer be able to serve as a safety feature.

Another important advantage of having the light source in the sidewall, as opposed to the bottom, the light source could be easily damaged by the weight of the contents, if they are heavy and dropped into the bag. Plus, with the light source in the bottom of the bag, if the bag is dropped, the light source can be damaged.

Lastly, when the light source is placed into the hem of the bag, there is the added advantage of machinery that already produces hemmed bags. Plastic bags having a hem and drawstring are known in the prior art. The machines presently used to make these bags can be used to produce a hemmed bag without a drawstring and used for this invention. Like the invention, the prior art bags with drawstrings in the hem have an opening in the interior side of the hem to accommodate the drawstring. This opening can now be used for the aforementioned insertion or removal of light sources. These are just a few of the advantages that are realized by the invention that do not exist in the prior art.

Figure 5:
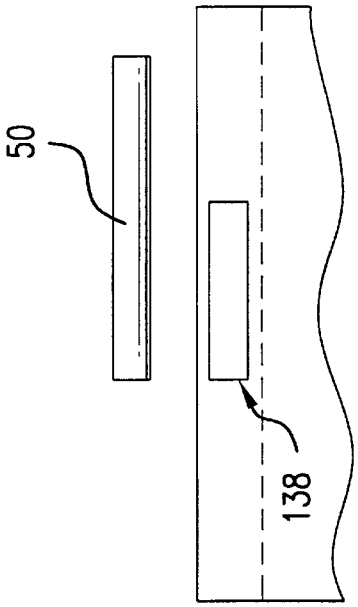
FIG. 5 shows the relationship between the glow stick and the opening in the hem of the alternative embodiment of the bag.
Figure 4:
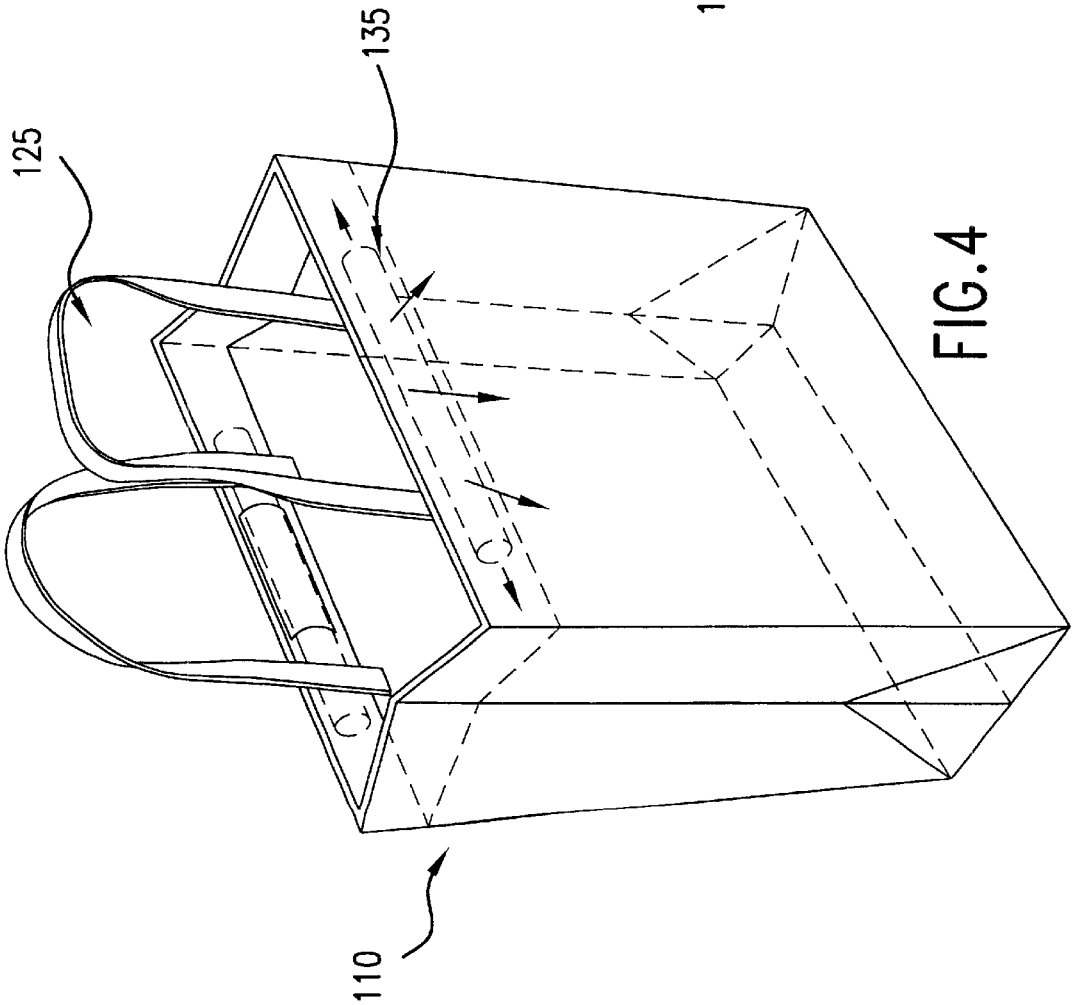
FIG. 4 is a perspective view of an alternative embodiment of the bag.

FIG. 4 shows an alternative view of the embodiment. In this embodiment, the bag 110 provided with vinyl or polyolefin handles 125 so that the bag is easy to carry. The top edge of the bag is folded over and secured to the inner surface of the walls to create a hem 135 having an inner wall provided with a slot 138. After folding over, the bag is preferably heat sealed to form the hem. In FIG. 5, the relationship between the glow stick 50 and the slot 138 for insertion of the glow stick into the hem is depicted. As can be seen, the length of the glow stick is at most equal to the distance between the edge of the bag and the furthest edge of the slot but at least as long as the slot 138.

Figure 6:
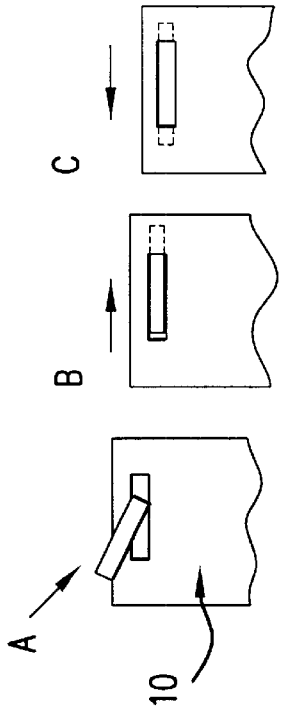
FIGS. 6A–6C depict a method of inserting the glow stick in the alternative embodiment of the bag.

FIGS. 6A–6C demonstrate how the glow stick is inserted into the hem. In FIG. 6A, the glow stick is inserted into the slot. As seen in FIG. 6B, the glow stick is moved all the way to the edge. When the glow stick is pushed all the way to the edge, the second end of the glow stick fits into the slot. The glow stick is then moved away from the edge as seen in FIG. 6C so that the glow stick is somewhat centered in the hem. In this final configuration, the glow stick extends pass both edges of the slot. When thus inserted, the stick is secured and will not accidentally be removed from the hem. By using this method, a glow stick that is larger than the opening is inserted into the hem and will be securely held in place until the user wishes to remove it.

While a preferred embodiment of the invention has been described, several modifications and variations would be obvious to one of ordinary skill in the art. The bag can be made of a front and back wall connected together, having no side or bottom wall. The front and back walls would be connected along three edges. The fourth edge of the front and back wall would define the opening. The bag may also be formed with a single side wall, resulting in a circular cross-section. The glow stick could be threaded about the entire perimeter until the end initially placed in the opening again reaches the opening. Also, the handle can be formed integrally with the bag instead of having separate handles that are attached to the bag.

We claim:

1. A lighted bag comprising:

a back wall and a front wall, said front wall having a first layer and second layer joined to one another to form a pouch, said pouch formed by and between said first and second layer and extending across the width of the front wall; and a light source in said pouch.

2. The lighted bag of claim 1, further comprising an opening in said second layer to allow the insertion and removal of said light source.

3. The lighted bag of claim 1, further comprising a first and second sidewall and bottom wall extending between said front and back wall.

4. The lighted bag of claim 1, wherein said front and back walls are made from translucent plastic.

5. The lighted bag of claim 1, wherein said light source is chemiluminescent.

6. The lighted bag of claim 2, wherein said opening is a slit.

7. A lighted bag, comprising:

a front wall and a back wall, each having a top edge, a bottom edge and side edges, said top edges defining an opening;

a hem formed about said opening and coextensive with said opening; and a light source in said hem.

8. The lighted bag of claim 7, further comprising an opening in said hem.

9. The lighted bag of claim 7, wherein said hem is formed by folding over the top of the front and back walls.

10. The lighted bag of claim 7, wherein said bag is made from transparent plastic.

11. The lighted bag of claim 7, wherein said bag is made from translucent material.

12. A lighted bag comprising:

at least one sidewall, a closed bottom and an open top, said top defining a top perimeter, a hem formed about the perimeter, said hem coextensive with said perimeter; and a light source retained in said hem.

13. The lighted bag of claim 12, wherein said light source extends about the entire top perimeter.

14. The lighted bag of claim 12, wherein said light source is a luminescent wand.

15. The lighted bag of claim 12, further comprising an opening in said hem for inserting and removing said light source.

16. The lighted bag of claim 12, wherein said opening is a slot.

17. The lighted bag of claim 12, wherein said opening is a slit.

18. The lighted bag of claim 1, wherein said light source is spaced from and substantially parallel to the bottom edge of the front wall.

19. The lighted bag of claim 1, wherein the width of the pouch is equal to the width of the front wall.

20. The lighted bag of claim 1, wherein said first layer and said second layer are joined along a fold line.

21. The lighted bag of claim 7, wherein said hem is substantially parallel to said bottom edge of said front wall and back wall.

22. The lighted bag of claim 12, wherein said hem is substantially parallel to said closed bottom.

* * * * *